US005678266A

United States Patent [19]

Petringa et al.

[11] Patent Number: 5,678,266

[45] Date of Patent: Oct. 21, 1997

[54] METHOD AND APPARATUS FOR SUPPORTING VARIOUS PARTS OF A PERSON'S BODY

[75] Inventors: Joseph Petringa, Needham, Mass.; Stanley K. Knighton; Susan Malone Knighton, both of Orange Beach, Ala.

[73] Assignee: P & K Products, Incorporated, Needham, Mass.

[21] Appl. No.: 525,467

[22] Filed: Sep. 8, 1995

[51] Int. Cl.[6] ..... A47C 16/00

[52] U.S. Cl. ..... 5/655.5; 5/632; 5/646; 5/722; 5/657; 5/909; 297/219.1

[58] Field of Search ..... 5/630, 632, 644, 5/646, 676, 685, 686, 722, 723, 691, 654, 655.5, 657, 909; 297/219.1

[56] References Cited

U.S. PATENT DOCUMENTS

| | | | |
|---|---|---|---|
| 3,293,671 | 12/1966 | Griffin | 5/657 X |
| 4,281,425 | 8/1981 | Jacobs | 5/676 |
| 4,471,538 | 9/1984 | Pomeranz | 5/909 X |
| 4,672,700 | 6/1987 | Poncy | 5/441 |
| 4,788,730 | 12/1988 | Bexton | 5/454 |
| 4,910,060 | 3/1990 | Nakanishi | 428/72 |
| 5,027,801 | 7/1991 | Grim | 128/80 |
| 5,129,391 | 7/1992 | Brodsky et al. | 128/380 |
| 5,152,023 | 10/1992 | Graebe | 5/654 X |
| 5,167,999 | 12/1992 | Wang | 5/655.5 X |
| 5,189,747 | 3/1993 | Mundy et al. | 5/654 |
| 5,255,404 | 10/1993 | Dinsmoor, III et al. | 5/451 |
| 5,356,099 | 10/1994 | Serboff | 248/118.1 |
| 5,388,295 | 2/1995 | Sarkozi | 5/630 |
| 5,390,384 | 2/1995 | Dinsmoor, III et al. | 5/654 |
| 5,409,500 | 4/1995 | Dyrek | 607/111 |
| 5,490,299 | 2/1996 | Dinsmour, III et al. | 5/654 |

OTHER PUBLICATIONS

Steridyne Corporation, Product Literature for "Zero–G Gel Flotation Devices", 1991, pp. 1–2.

Mason Medical Products, Product Literature for "Decubitus Care Products", Catalog No. DCP4, pp. 1–4.

Skil–Care Corporation, Product Literature for "Ultra–Wedge Cushion", pp. 1–2.

Case Logic, Inc., Product Packaging for "Gel–eez Wrist–Rest", Product No. GL1, Item No. 6182001, 1995.

3M, Product Literature for "Gel–Filled Adjustable Wrist Rest", Products Nos. WR510, WR511 & WR512, pp. 1–5.

*Primary Examiner*—Michael F. Trettel

*Attorney, Agent, or Firm*—Wolf, Greenfield & Sacks, P.C.

[57] ABSTRACT

A method and apparatus for supporting a person in a seated or lying position, and for supporting a person's appendages, such as arms, wrists, hands and elbows, above a work surface. An appendage can be rested on an upper surface of a support pad provided on a work surface, the support pad having a plurality of fluid-filled cells separated by a plurality of seams. The support pad can be folded along at least one of the plurality of seams so that a first portion of the plurality of cells lies above a second portion of the plurality of cells to adjust the height of the support pad above the work surface. A portion of the plurality of cells can be removed from the support pad to create a desired configuration for a support pad. The support pad can be configured and used as a wrist rest for operating data input devices, such as a keyboard, a computer mouse, and a calculator, and used as an arm rest for writing or performing manual tasks on a work surface. The same support pad can be configured and used as a wrist/arm rest in a first manner, the reconfigured and used as a wrist/arm rest in a second manner. The support pad can also be used as a back support and a seat cushion, and used in a seat cushion assembly and in a mattress overlay.

29 Claims, 7 Drawing Sheets

METHOD AND APPARATUS FOR SUPPORTING VARIOUS PARTS OF A PERSON'S BODY

FIELD OF THE INVENTION

The present invention relates generally to a method and apparatus for supporting various parts of a person's body. More particularly, the present invention is directed to a method and apparatus for supporting a person in a seated or lying position, and for supporting a person's appendages, including arms, hands, wrists and elbows, above a work surface.

BACKGROUND OF THE INVENTION

People working in today's office and industrial environments can experience various physical ailments associated with performing particular tasks during a typical workday. For example, workers in an industrial environment can experience reduced blood flow to their appendages when placing their arms, wrists or hands on hard work surfaces while performing various tasks, such as trouble shooting equipment, assembling products, or performing experiments. Another common ailment experienced by persons in an office who regularly operate data input devices, such as keyboards, computer mouses and calculators, is carpal tunnel syndrome, which is caused by a swollen tendon pressing on a nerve in a person's wrist. A lack of support or improper support of the wrists and hands can lead to carpal tunnel syndrome.

Devices have been developed to support an individual's appendages in an effort to alleviate the symptoms associated with carpal tunnel syndrome and reduced blood flow. These devices can particularly be found in the office environment for use with keyboards and computer mouses. Generally, such devices are specifically designed for one particular function and may include an assembly of bulky components. Additionally, many of these devices use foam pads which may not properly support a a person's appendages because the foam is too soft, or may not alleviate the physical ailments because the foam is too hard.

Support devices have also been developed that utilize fluid-filled pads, such as gel-filled pads to support portions of a person's anatomy. For example, gel-filled pads have been used in seat cushions and bed mattresses to help alleviate sores and ulcers associated with long term confinement to a wheelchair or bed. Gel has become a much utilized medium for supporting individuals because it more readily conforms to the body to uniformly distribute pressure and reduce forces on the body. Gel-filled support pads generally include a single large pad that is relatively bulky, heavy and cannot be folded or adjusted because a large volume of gel is required to prevent gel pooling or displacement when supporting an individual.

It is an object of the present invention to provide an improved method and apparatus for supporting various parts of a person's body.

SUMMARY OF THE INVENTION

In one illustrative embodiment of the invention, a method is provided for supporting a person's appendage above a work surface. The method includes steps of placing a support pad on the work surface, and resting the appendage on the support pad above the work surface. The support pad includes a plurality of fluid-filled cells separated by a plurality of seams.

In another illustrative embodiment of the invention, the support pad can be folded along at least one of the plurality of seams so that a first portion of the plurality of cells lies above a second portion of the plurality of cells. Thus the height of the upper surface of the support pad can be adjusted relative to the work surface by the number of folds applied to the support pad.

In a further illustrative embodiment of the invention, at least one cell may be removed from the support pad to fit a particular configuration of a work station.

In another illustrative embodiment of the invention, the support pad can be folded along more than one of the plurality of seams.

In a further illustrative embodiment of the invention, the support pad is used as a wrist/arm rest to support an individual's wrists, arms and hands adjacent various data input devices, such as a keyboard, a computer mouse, and a calculator.

In another illustrative embodiment of the invention, the multi-cell fluid-filled support pad is used as an arm and wrist rest to support an individual's arms and wrists when performing various tasks on a work surface, such as writing, trouble shooting equipment, performing experiments, and assembling products.

In a further illustrative embodiment of the invention, a single multi-cell fluid-filled support pad can be configured in a first manner and used as a wrist rest adjacent a keyboard and reconfigured and used as a wrist rest adjacent a computer mouse. The pad can be further reconfigured and used as a wrist and/or arm rest adjacent a calculator, or as an arm rest on a work surface. The various configurations can be attained by folding, unfolding, and rotating the pad on the work surface.

In another illustrative embodiment of the invention, at least one cell can be removed from the support pad to fit the pad into particular work station configurations, and the support pad can be folded along at least one of the seams to adjust the pad height relative to a work surface of a work station.

In another illustrative embodiment of the invention, the multi-cell fluid-filled support pad is attached to a seat back and used as a back support.

In another illustrative embodiment of the invention, the multi-cell fluid-filled support pad is placed on a seat and used as a seat cushion. The fluid-filled support pad can be used alone as a seat cushion, or it can be combined with one or more foam pads. In another illustrative embodiment of the invention, the support pad is used in a mattress overlay. A support pad or a plurality of support pads can be selectively positioned between two layers of a compressible material to support various parts of a person's body when lying on a bed.

Numerous other objects, features and advantages of the invention should become apparent upon a reading of the following detailed description taken in conjunction with the accompanying drawings.

DETAILED DESCRIPTION

Figure 1:
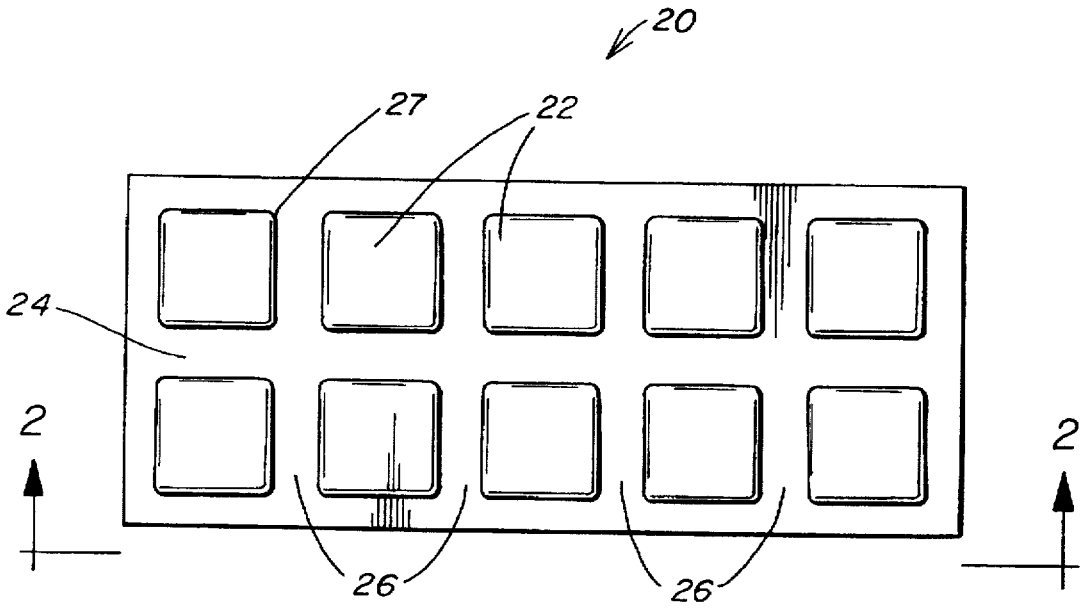
FIG. 1 is top plan view of an illustrative embodiment of a support pad in accordance with the present invention.
Figure 2:
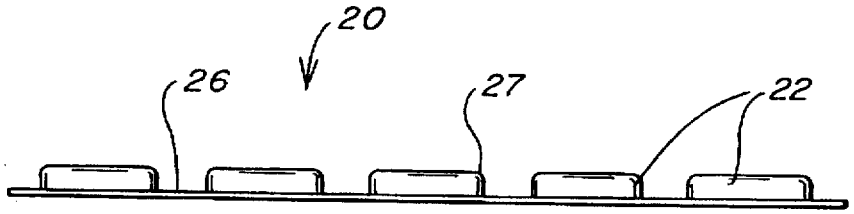
FIG. 2 is a side elevational view of the support pad of FIG. 1 taken along view line 2—2 of FIG. 1.

The present invention is directed to a method and apparatus for supporting a person in a seated or lying position, and for supporting a person's appendages, including hands, wrists, arms or elbows, when performing various tasks. An example of a support pad 20 for use in connection with the present invention is shown in FIGS. 1 and 2. The support pad 20 includes a plurality of fluid-filled cells 22 separated from each other by a grid of seams that includes a longitudinal seam 24 and transverse seams 26. The grid of seams 24,26 isolates the cells 22 from one another to create separate fluid compartments. The support pad seams 24,26 are flexible so that a user can selectively fold the support pad 20 along the longitudinal seam 24 and the transverse seams 26 to achieve a desired configuration. The pad 20 may be placed on any number of surfaces to support a seated or lying person, or a person's appendages. When used to support an appendage, the cells 22 conform to the individual's hands, wrists, elbows, or arms to more uniformly distribute forces away from pressure points to reduce the restriction of blood flow. Similarly, the cells 22 reduce the chance of a person developing body sores when a pad is used to support a person in a seated or lying position.

The cells 22 are preferably of a generally square shape, having corners 27 that are rounded for increased comfort, and arranged in an array of columns and rows which make the support pad 20 compact and easy to fold into various configurations. An array of cells should include at least four cells arranged in at least two columns by two rows. FIG. 1 illustrates the support pad 20 as having an array of ten cells 22 arranged in a rectangular grid of five columns by two rows. However, it should be understood that this particular configuration is exemplary and that support pads having various other cell configurations can be utilized. Furthermore, cells 22 can also have various other shapes. For example, the cells can be formed to have rectangular, triangular or round shapes.

Figure 3:
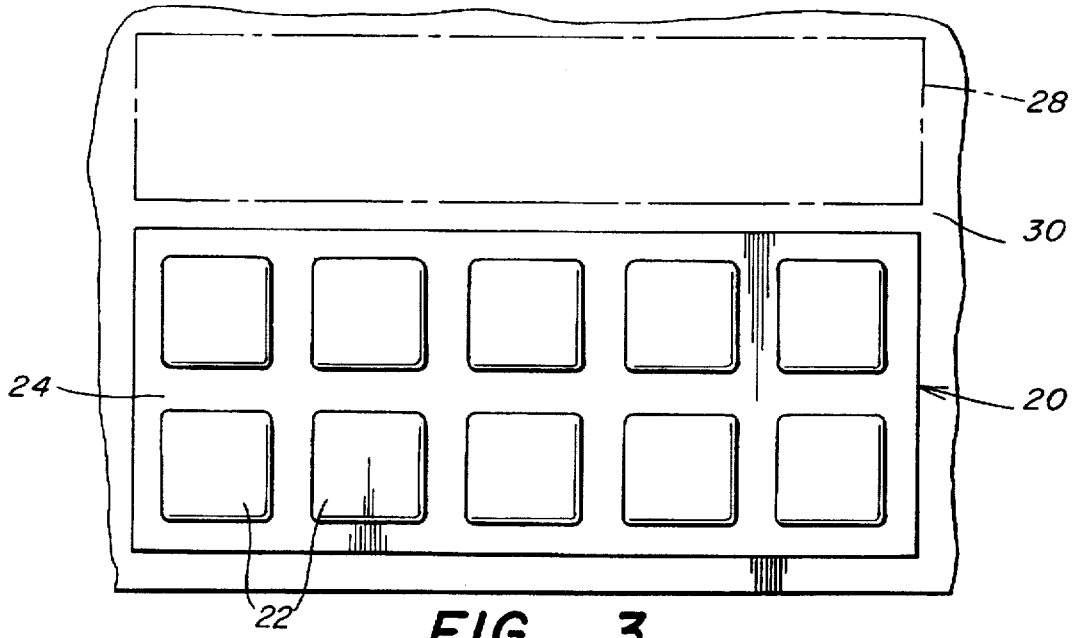
FIG. 3 is a partial top plan view of the support pad of FIGS. 1–2 placed on a support surface adjacent a data input device.
Figure 4:
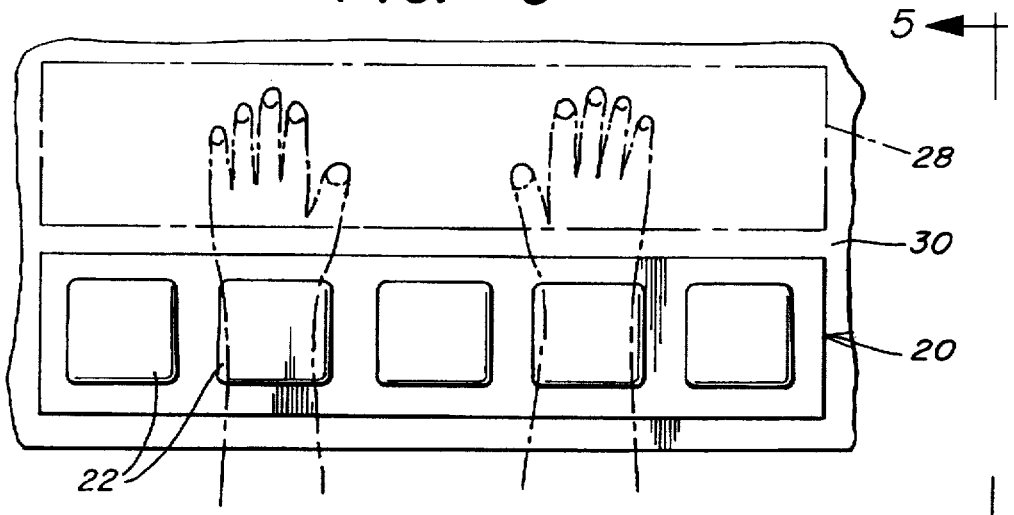
FIG. 4 is a top plan view of the support pad of FIG. 3 folded over itself along a longitudinal seam and placed on a support surface adjacent a data input device.
Figure 5:
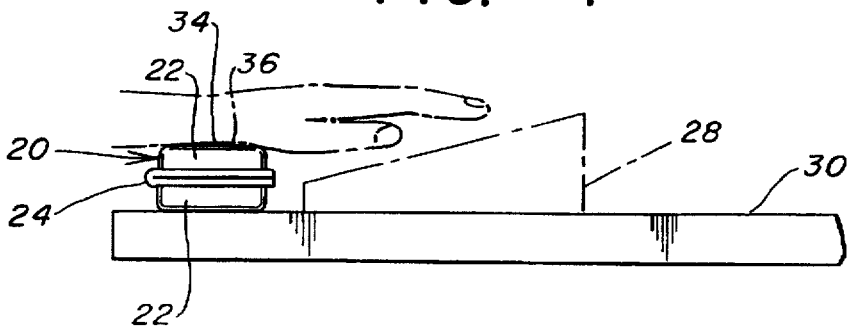
FIG. 5 is the side elevational view of FIG. 4 illustrating a person's appendage resting on the support pad adjacent a data input device.

One use for the support pad of FIGS. 1–2 is to support the arms and wrists of a user of a data input device in an office environment, such as, for example, a keyboard, a computer mouse or a calculator. FIGS. 3–5 illustrate an elongated data input device 28 (e.g., a keyboard) that is operated using two hands. In accordance with one embodiment of the present invention, the support pad 20 can be positioned adjacent the input device 28 on a support surface 30 (e.g., a tabletop) with the rows of cells extending parallel to the input device 28. The support pad 20 can either be placed flat on the support surface 30, as shown in FIG. 3, or folded along the longitudinal seam 24, as shown in FIGS. 4 and 5, to adjust the height of the upper surface 34 (FIG. 5) of the support pad 20 relative to the input device 28. When folded along the longitudinal seam 24, one row of cells 22 overlies the other. As shown in FIG. 5, when using the input device 28, the upper surface 34 of the support pad 20 supports the palm and wrist area 36 of the user in a deformable manner. This arrangement provides support that soft foams cannot provide, and it does not restrict the flow of blood as experienced with hard foams.

Figure 6:
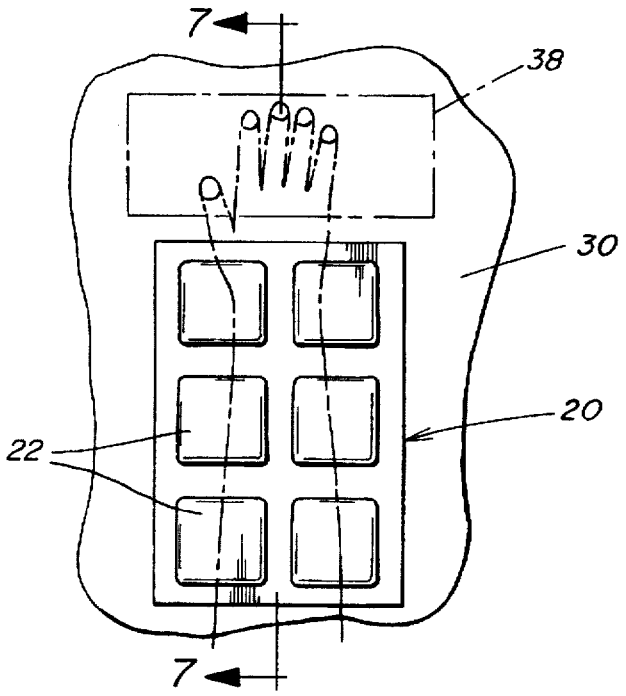
FIG. 6 is a partial top plan view of the support pad of FIGS. 1–2 folded along a transverse seam onto itself and placed on a support surface adjacent a data input device.
Figure 7:
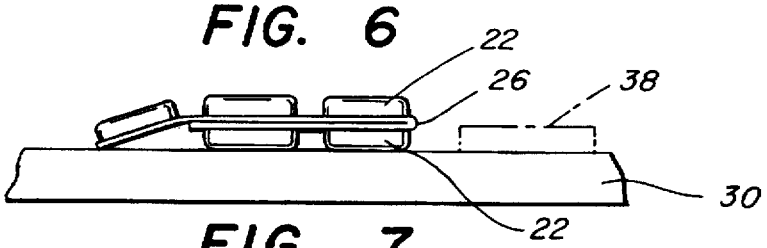
FIG. 7 is a side elevational view taken along view line 7—7 of FIG. 6.

Another use for the support pad 20 is illustrated in FIGS. 6 and 7, in which the support pad is placed on a support surface 30 adjacent a different type of input device 38, such as a calculator or computer mouse, which typically needs support for only one of the user's wrists and arms. The pad can be placed lengthwise on the support surface to support the user's arm. The pad can be placed flat, or the user can fold the support pad 20 along any of the seams. As shown in FIG. 7, when the support pad 20 is folded along a transverse seam 26, one or more (two in the example of FIG. 7) columns of cells underlie adjacent columns of cells. In this manner, the user's wrist can be elevated above the support surface to any desired height relative to the device 38.

Figure 8:
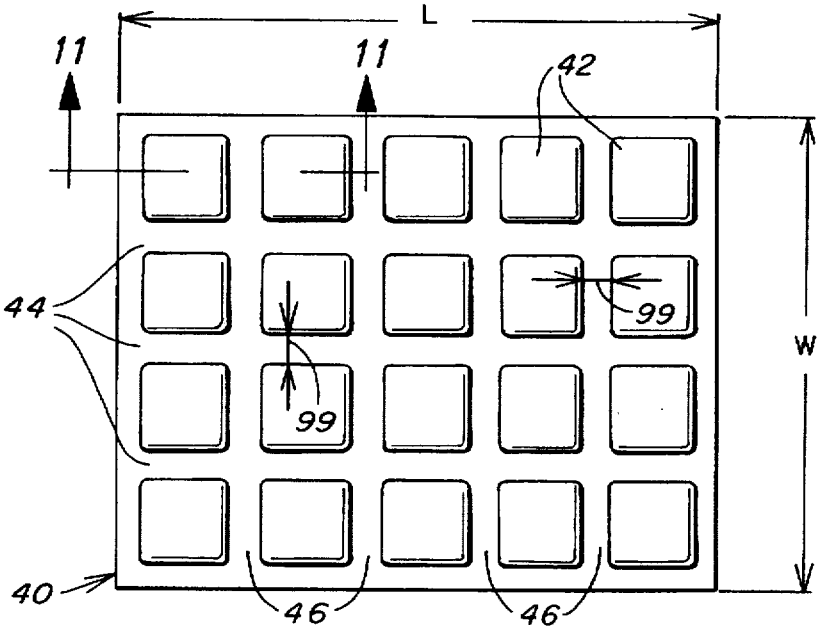
FIG. 8 is a top plan view of another embodiment of a support pad according to the present invention.

The configuration of the support pad 20 as shown in FIGS. 7 and 8 could also be used to support an individual's wrist and hand while writing on a tabletop instead of operating the input device 38. In each of the uses described above, the cells 22 of the support pad 20 should face the user's appendages to provide maximum support.

It should be understood that a user needs to have only one support pad 20, which can be configured and reconfigured as desired, to support his appendages when performing any of the above-described tasks. For example, the user can configure the pad to support his wrists when using a computer keyboard, and then reconfigure the same pad when he wishes to use the computer mouse. Similarly, the user can also reconfigure the pad to support his arm when writing on a work surface, or to support his wrist when using a calculator.

Figure 9A:
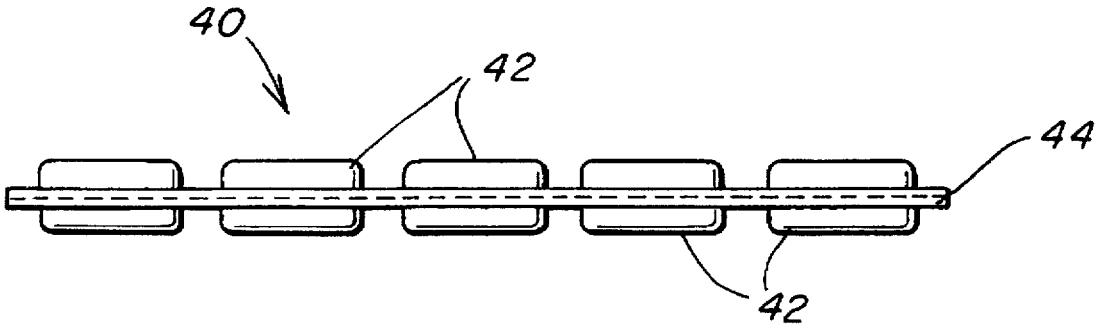
FIG. 9A is a side elevational view of the support pad of FIG. 8 folded in half along a longitudinal seam.
Figure 9B:
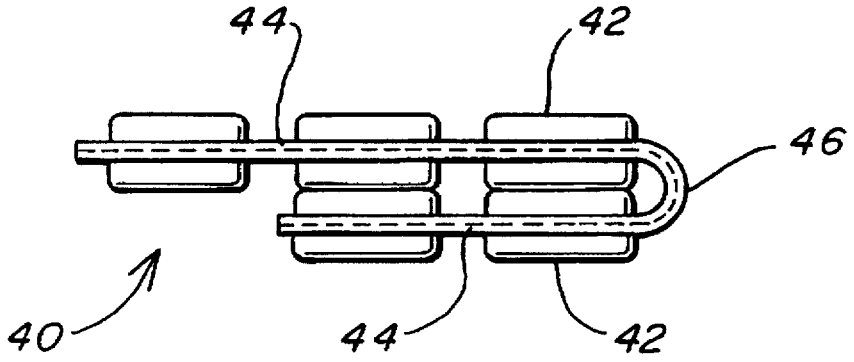
FIG. 9B is a side elevational view of the folded support pad in FIG. 9A further folded along a transverse seam.
Figure 10:
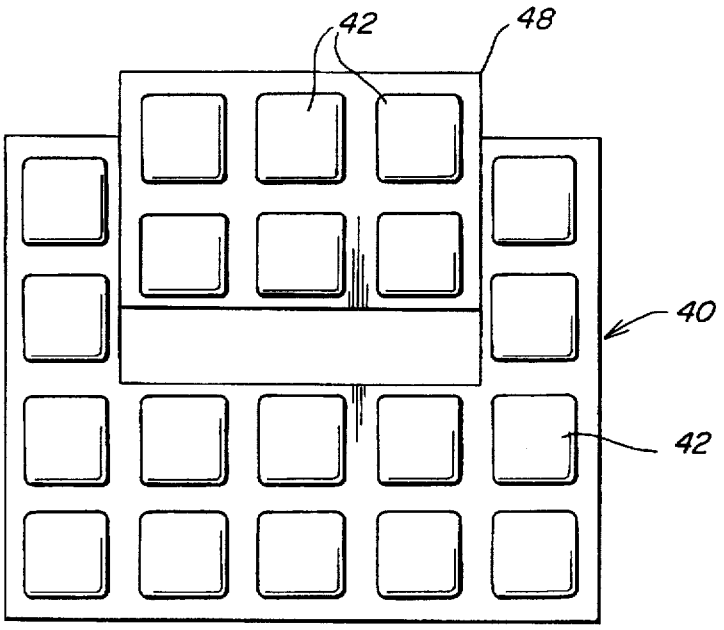
FIG. 10 is a top plan view of the support pad of FIG. 8 having a portion of the fluid-filled cells removed therefrom.

FIG. 8 illustrates a support pad 40 that is similar in many respects to the pad 20 of FIGS. 1–3, but includes a greater number of cells 42. The support pad 40 can be used in an industrial environment wherein a larger support surface is desired than in the office environment. The support pad 40 can be placed on a work surface (e.g., a tabletop) to support a user's wrists, forearms or arms with the support pad 40 in a flat or folded configuration. The support pad 40 can be folded along a single longitudinal seam 44 or transverse seam 46, along multiple longitudinal or transverse seams, or along a combination of both longitudinal and transverse seams, as desired to achieve any configuration suitable for the user's needs. An example of this versatility is demonstrated in FIGS. 9A–9B in which a support pad 40 is first folded along a longitudinal seam 44 (FIG. 9A) and then folded along a transverse seam 46 resulting in a pad configuration (FIG. 9B) that has four layers of four cells stacked over each other. Furthermore, individual cells 42 or groups of cells 48 can be removed from the pad 40, as shown in FIG. 10, to customize the shape of the support pad 40 to fit specific workstation configurations. Furthermore, individual cells 42 or groups of cells can be removed from the middle of the pad so that the pad forms a continuous support structure with an opening in the middle to be placed around a work piece. Examples of industrial uses for support pad 40 include laboratory and factory environments in which the pad 40 supports a technician's or worker's arms and wrists on a support surface while performing various tasks, such as performing experiments, trouble shooting equipment or assembling products.

As discussed above, support pads 20 and 40, which each has a plurality of cells 22, 42 separated by longitudinal seams 24, 44 and transverse seams 26, 46, are extremely versatile and can be used in numerous configurations. The separate cells 22, 42 minimize fluid displacement when pressure is applied to the support pad, and prevent pooling of the fluid which is typically encountered in conventional large volume single bladders. Furthermore, the use of separate cells provides the flexibility that allows the pad to be folded into various configurations. The cells 22,42 of the support pad 20,40 should face the user in order to provide maximum support.

Figure 11:
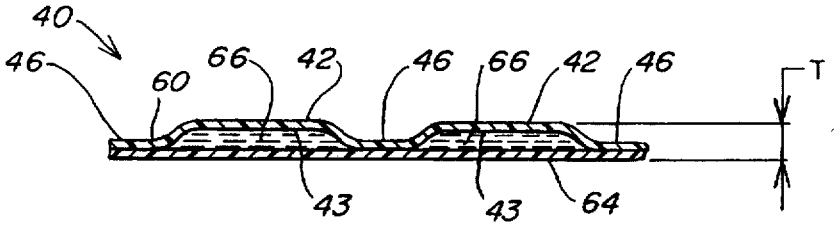
FIG. 11 is a partial cross-sectional view taken along section line 11—11 of FIG. 8.

FIG. 11 shows an exemplary construction of the support pad 40. It should be understood that support pad 20 only varies from pad 40 in size, and is made in the same manner. Support pad 40 includes a top layer 60 and a bottom layer 64. Cavities 43 are vacuum formed into the top layer 60 in a manner known in the art. Fluid 66 is then inserted into each cavity 43. After the fluid 66 is inserted into the cavities 43, the bottom layer 64 is bonded to the top layer 60 along each seam 44,46 to create the individual fluid-filled cells 42. Each cell is preferably substantially filled with fluid 66, although partially filled cells can be used.

The pads 20,40 may be formed of any suitable materials. In one embodiment of the invention, the top layer 60 and the bottom layer 64 are each made from a vinyl material, and the fluid is a gel. Vinyl material of 15 to 20 gauge thickness is preferred for the layers 60,64 because it is easily formed, flexible, tough, puncture resistant and washable. The top layer 60 and bottom layer 64 are bonded to each other along each seam 44,46 by applying an RF (radio frequency) weld, also known as a dielectrical heat seal. The width of each seam 44,46 should be sized to withstand anticipated pressures and prevent leakage of the fluid 66 from the cells 42, and to allow the pad to be folded along each seam. In one embodiment of the invention, the vinyl is treated with an antibacterial agent to inhibit bacterial growth on each pad surface.

Gel is the preferred fluid for the support pad because it is more viscous than water, resulting in a support medium that is particularly suited to conform to an individual's shape. However, it should be understood that water, as well as other fluids, can also be utilized as the support medium 66.

Exemplary dimensions for the support pad 40 of FIG. 8 include a length L of approximately 17 inches, a width W of approximately 14 inches and a thickness T (FIG. 11) of approximately 0.5 inches. The cells 42 are arranged in an array of twenty cells having a rectangular grid of five columns by four rows, each cell 42 being approximately three inches by three inches. The longitudinal seams 44 and the transverse seams 46 are each approximately 0.38 inches in width as shown at 99. The support pad 20, as shown in FIGS. 1–7, can be obtained simply by cutting the support pad 40 in half along a central longitudinal seam 44. It should be understood that while these dimensions have been found to be useful, they are merely exemplary and the invention is not limited to a support pad having these dimensions.

Although a number of uses for the multi-celled, fluid-filled support pads of FIGS. 2 and 8 have been described above, it should be understood that many other applications can be realized. For example, a support pad similar to the twenty cell configuration described above can be placed directly on a seat, such as a stadium seat, and used as a cushion. Another use involves placing the support pad on an automobile center console located between the front seats of the automobile to use as an arm rest. A further use includes placing a relatively large support pad or a plurality of smaller pads on an operating table to support a patient undergoing surgery.

The above-described uses for the multi-celled, fluid-filled support pad of the present invention each involve the use of the pad by itself. The present invention is also directed to other methods of use of the support pad in conjunction with other components.

Figure 12:
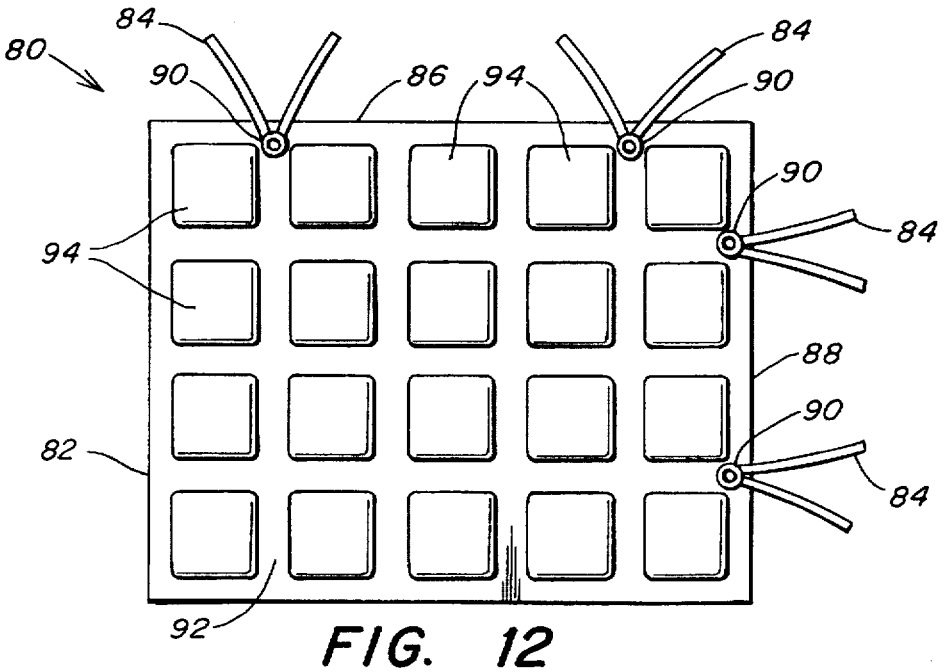
FIG. 12 is an embodiment of the support pad for use as a back support.
Figure 13:
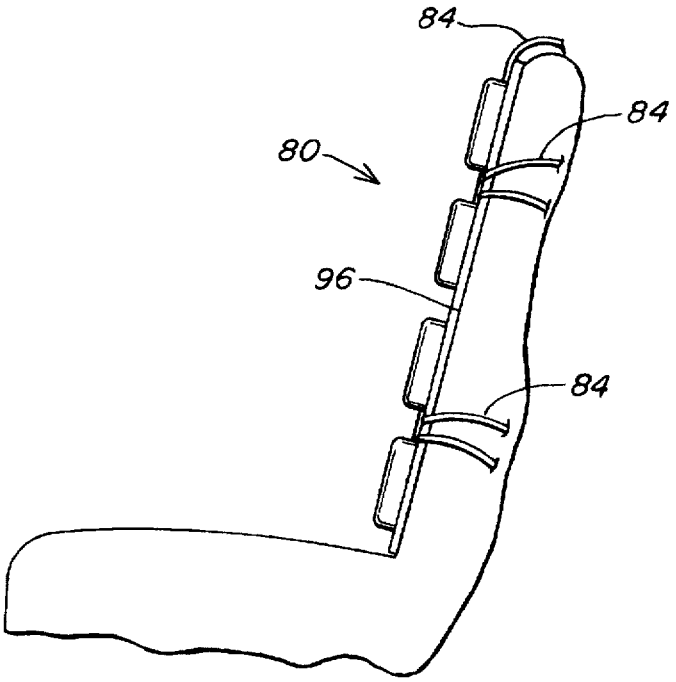
FIG. 13 is a side elevational view of the back support of FIG. 12 attached to a seat back.

In another embodiment of the present invention, a pad similar to the one described in connection with FIGS. 8–11 is used as a back support pad 80, as shown in FIGS. 12–13. The back support pad 80 includes a support pad 82, similar to the twenty cell pad 40 described above, having a plurality of cells 94 and straps 84 attached to the support pad 82 along edges 86, 88 of the pad. To reinforce the attachment points of the straps 84 to the support pad 82, metal or plastic grommets 90 may be installed along the perimeter of the pad, preferably adjacent a seam 92 separating adjacent cells 94. As shown in FIG. 13, the back support pad 80 can be placed against and secured to a chair back 96 using the straps 84. The straps 84 may be conventional hook and loop fastener-type straps, simple tie straps that a user ties together, or any other suitable strap. Preferably, straps 84 are provided on at least two edges 86, 88 so that a user may orient the back support pad in one of two positions to allow for narrow and wide chair backs. The use of the multi-celled support pad 82 prevents fluid from pooling at the base of the chair back 96 when the pad 80 is orientated in a vertical direction. It should be understood that the back support pad 80 is not limited to twenty cells, and it can be any size that is compatible with the chair back size.

Figure 14:
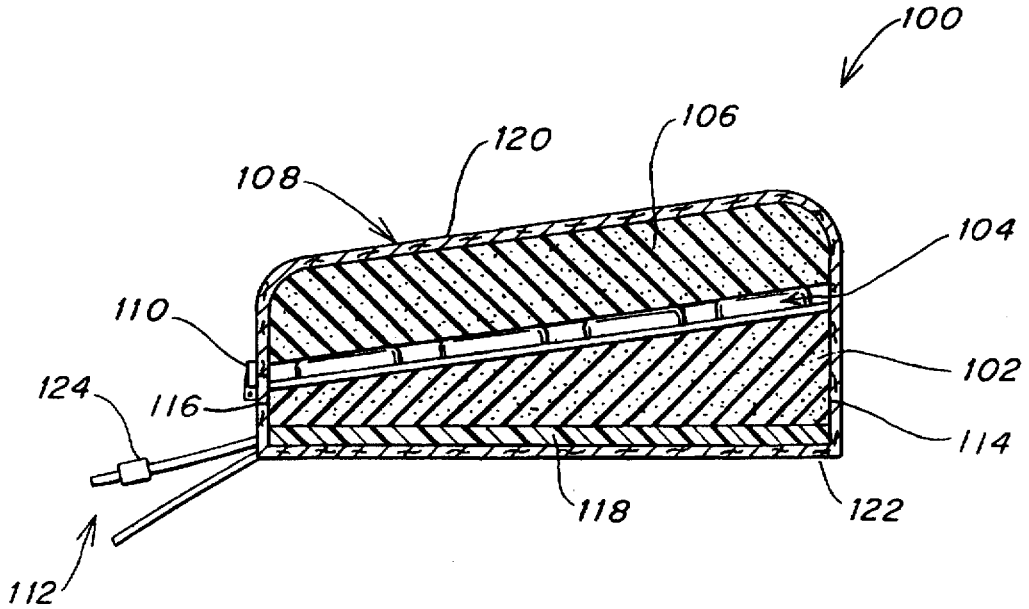
FIG. 14 is a cross-sectional view of an embodiment of the present invention, wherein the support pad of FIG. 8 is used to form a seat cushion.

Another embodiment of the present invention, shown in FIG. 14, is directed to a seat cushion formed using the above-described multi-cell, fluid-filled support pad. The chair cushion 100 includes a base pad 102, a multi-cell, fluid-filled support pad 104 bonded to the top surface of the base pad 102, and a seat pad 106 bonded to the support pad 104 and upon which a person sits. The three pads are enclosed within a seat cover 108 that includes a rear zipper 110 and strap 112 for attaching the seat cushion 100 to a support such as a chair.

In the embodiment shown in FIG. 14, the base pad 102 is of a wedge shape that tapers away from the front wall 114 of the base pad 102 toward the rear wall 116. The wedge shape of the base pad 102 assists in maintaining a seated individual in an upright position so that the individual will not slump forward and fall off the seat. The zipper 110 allows the cover 108 to be easily removed and replaced, and allows an optional rigid base 118 to be inserted between the base pad 102 and cover 108 for use with sling-type wheel chairs. The optional rigid base 118 prevents the seat cushion 100 from sagging under the weight of an individual when used with a sling-type wheel chair. The strap 112 can be sewn into a seam of the cover 108.

In one embodiment of the invention, the base pad 102 is a high density polyurethane foam having a width of approximately 18 inches, a depth of approximately 16 inches and a thickness of approximately 1.5 inches at the front wall 114 tapering to a thickness of approximately 0.5 inches at the rear wall 116. The seat pad 106 is made from a memory foam approximately 1.5 inches thick and is bonded to the top of the support pad 104. Memory foam will conform to the shape of an individual under pressure and will maintain this shape for a period of time after pressure is released before returning to its original shape. Generally, memory foam provides more support as compared to standard foams such as polyurethane.

The cover 108 includes a top layer 120 adjacent the seat pad 106 and a bottom layer 122 adjacent the base pad 102. The top layer 120 can be made from a soft and flexible material that is washable, impervious to fluids and inhibits bacterial growth. An example of a material with these characteristics that can be used for the top layer 120 is sold under the trademark STAPH CHEK™. The bottom layer 122 can be made from a flexible wear resistant material such as a nylon. An example of such a material is sold under the trademark CORDURA™.

The optional rigid base 118 can be made from any rigid material such as wood, plastic or other material that combines rigidity with light weight. When the other components of the seat cushion have the dimensions listed above, the rigid base 118 can be approximately 18 inches wide, 16 inches deep and 0.38 inches thick.

The strap 112 can include any suitable arrangement that will securely attach the chair cushion 100 to a chair. For example, the strap 112 can include a buckle 124, or a conventional hook and loop fastener arrangement.

Figure 15:
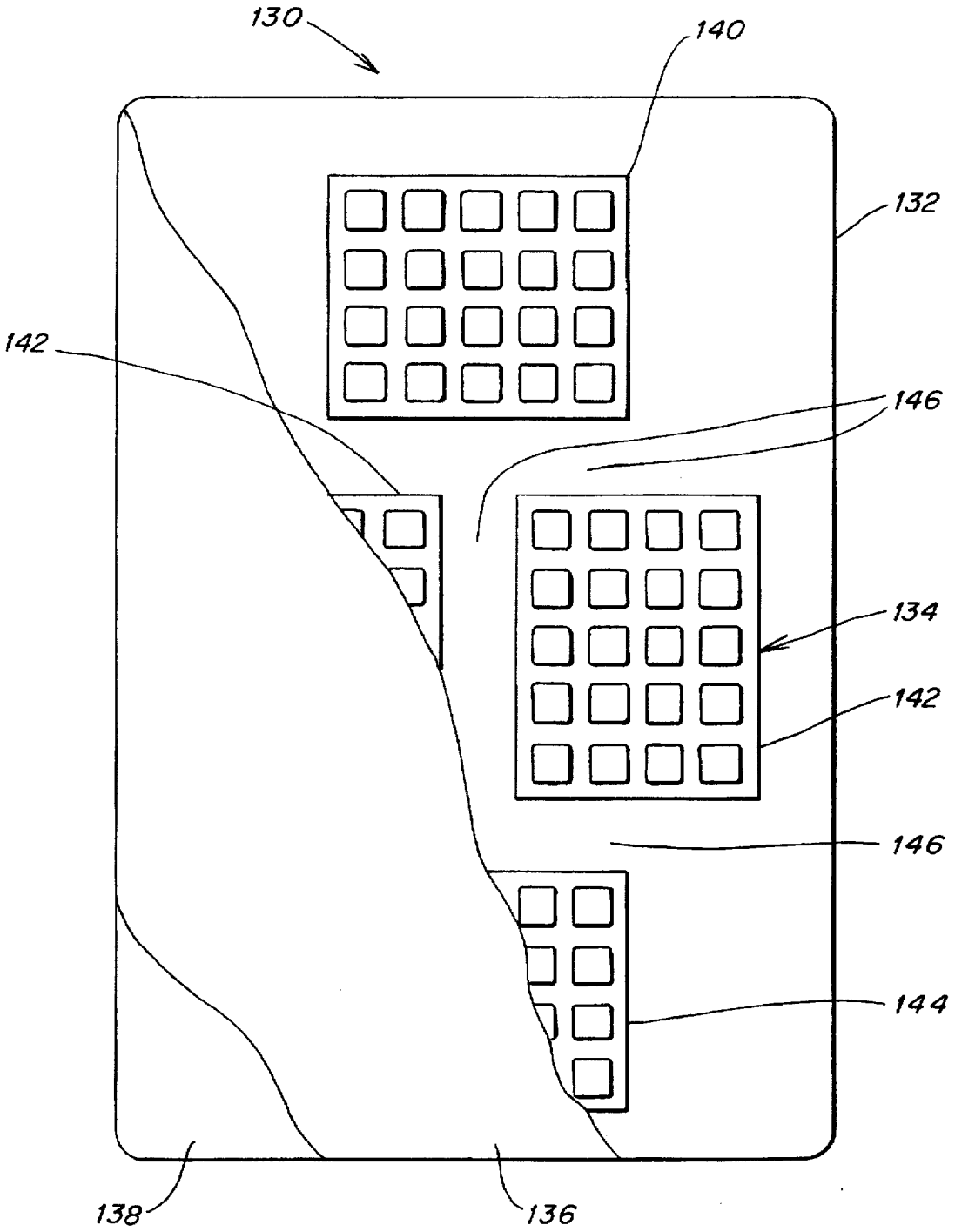
FIG. 15 is a partial top plan view of an embodiment of the present invention, wherein the support pad of FIG. 8 is used to form a mattress overlay.

Another embodiment of the present invention, shown in FIG. 15, is directed to a mattress overlay that incorporates a multi-cell, fluid-filled support pad such as the one described above. The mattress overlay 130 is a compact, lightweight gel/foam overlay that can be used on a standard bed mattress or a hospital bed mattress. The mattress overlay 130 helps prevent bed sores by reducing the pressure on an individual's shoulders, buttocks and heels, which are the portions of an individual's body that typically experience bed sores.

The mattress overlay includes a bottom layer 132, a plurality of multi-cell, fluid-filled support pads 134, a top layer 136 and a cover 138. The support pads 134 are positioned on the bottom layer 132 so that they will underlie an individual's shoulders, buttocks and heels. Preferably, as shown in FIG. 15, one support pad 140 is positioned below the individual's shoulders, two support pads 142 are positioned below the individual's buttocks and one support pad 144 is positioned below the individual's heels. In the embodiment shown in FIG. 15, the support pads include twenty cells, but the number of cells can be increased or decreased as desired. The shoulder and heel pads 140, 144 are positioned so that their lengths run across the width of the bottom layer 132 and the buttock pads 142 are positioned so that their lengths run parallel to the length of the bottom layer 132. The support pads 134 are sandwiched between and bonded to the bottom layer 132 and the top layer 136 using an adhesive. As shown in FIG. 15, the support pads are positioned apart from each other so that spaces 146 exist between the pads enabling the bottom layer 132 and the top layer 136 to be bonded together around each pad 134 to enhance the structural integrity of the mattress overlay 130, and to maintain the pads 140, 142, 144 in their desired positions.

The bottom layer 132 and the top layer 136 can be made from a medical grade polyurethane foam, such as a 1.8 lb. density, #40 ILD foam. In one embodiment of the invention, each layer is approximately 34 inches wide, 74 inches long and 1 inch thick resulting in a mattress overlay that has a total thickness of approximately 2 inches, wherein the support pads are approximately 0.5 inches thick. The total weight of the mattress overlay is approximately 16 lbs. This light weight can be achieved because the use of multi-cell pads reduces the volume of fluid that is required to support an individual. The overlay cover 138 preferably is made from an antibacterial, waterproof and washable vinyl material. The overlay cover 138 can be either a zippered or fitted cover designed to fit over a standard bed mattress and the mattress overlay 130.

In addition to being compact and lightweight, the use of the multi-cell support pads 134 minimizes the possibility of pooling the fluid, and provides the mattress overlay 130 with the flexibility to conform to the contours of different positions of an elevated electric bed. Furthermore, the multi-cell support pads can be selectively and independently positioned in the mattress overlay to support particular portions of an individual's body.

Having described illustrative embodiments of the invention in detail, those skilled in the art will appreciate that numerous modifications may be made to these embodiments without departing from the spirit of the invention. Therefore, it is intended that the breadth of this invention not be limited to the specific embodiments illustrated and described. Rather, the breadth of the invention is to be determined solely by the appended claims and their equivalents.

What is claimed is:

1. A method for supporting a body appendage above a work surface, the method comprising steps of:

(a) placing a support pad on the work surface, the support pad including a plurality of fluid-filled cells separated by a plurality of seams;

(b) adjusting the support pad into a user selected configuration by folding the support pad along at least one of the plurality of seams so that a first group of the plurality of cells lies above a second group of the plurality of cells; and (c) resting the body appendage on the support pad above the work surface.

2. The method as recited in claim 1, wherein step (c) includes resting a wrist on the support pad.

3. The method as recited in claim 1, wherein step (c) includes resting an arm on the support pad.

4. The method as recited in claim 1, wherein step (c) includes resting an arm and a wrist on the support pad.

5. The method as recited in claim 1, further comprising a step of: (d) positioning the support pad adjacent a data input device.

6. The method as recited in claim 5, wherein step (d) includes positioning the support pad adjacent a keyboard.

7. The method as recited in claim 5, wherein step (d) includes positioning the support pad adjacent a computer mouse.

8. The method as recited in claim 5, wherein step (d) includes positioning the support pad adjacent a calculator.

9. A method for supporting a body appendage above a work surface, the method comprising steps of:

(a) placing a support pad on the work surface, the support pad including a plurality of fluid-filled cells separated by a plurality of seams;

(b) adjusting the support pad into a user selected configuration by removing at least one of the plurality of cells from the support pad; and (c) resting the body appendage on the support pad above the work surface.

10. The method as recited in claim 9, wherein step (b) includes a step of:

folding the support pad along at least one of the plurality of seams so that a first portion of the plurality of cells lies above a second portion of the plurality of cells.

11. A method for supporting a body appendage on a work surface, the method comprising steps of:

(a) adjusting a support pad into a first configuration, the support pad including a plurality of fluid-filled cells separated by a plurality of seams;

(b) positioning the support pad in a first position on the work surface;

(c) resting the body appendage on the support pad in the first position;

(d) readjusting the support pad into a second configuration;

(e) repositioning the reconfigured support pad in a second position on the work surface; and (f) resting the body appendage on the support pad in the second position, wherein at least one of steps (a) and (d) includes a step of folding the support pad along at least one of the plurality of seams so that a first portion of the plurality of cells overlies a second portion of the plurality of cells.

12. The method as recited in claim 11, wherein step (a) includes a step of folding the support pad along at least one of the plurality of seams, and step (d) includes a step of unfolding the support pad.

13. A seat cushion comprising:

a base pad having an upper surface, a front wall and a rear wall, the base pad being wedge-shaped so that the upper surface tapers from a first thickness at the front wall to a second thickness at the rear wall;

a support pad including a plurality of fluid-filled cells arranged in an array of cells, the support pad disposed on the upper surface of the base pad with the plurality of cells facing away from the base pad; and a seat pad disposed on the support pad.

14. The seat cushion as recited in claim 13, further comprising a rigid base disposed adjacent a bottom surface of the base pad opposite the upper surface to prevent sagging of the seat cushion when supporting an individual.

15. The seat cushion as recited in claim 13, further comprising a cover enclosing the base pad, the support pad and the seat pad.

16. The seat cushion as recited in claim 15, further comprising a rigid base disposed between the base pad and the cover to prevent sagging of the seat cushion.

17. The seat cushion as recited in claim 16, wherein the cover has an access opening through which the rigid base can be inserted into or removed from the seat cushion.

18. The seat cushion as recited in claim 15, further comprising a strap, disposed on the cover, to attach the seat cushion to a chair.

19. The seat cushion as recited in claim 13, wherein the seat pad is comprised of a memory foam material.

20. The seat cushion as recited in claim 13, wherein the fluid in at least one of the plurality of fluid-filled cells is a gel material.

21. A mattress overlay comprising:

a first cushion layer of a resilient material;

a plurality of support pads, each of the plurality of support pads including a plurality of fluid-filled cells separated by a plurality of seams and arranged in an array of cells, each of the plurality of support pads disposed on the cushion first layer and being selectively positioned to support portions of an individual's body when the person is lying on a mattress; and a second cushion layer of a resilient material disposed on the plurality of support pads.

22. The mattress overlay as recited in claim 21, wherein the first cushion layer, the plurality of support pads and the second cushion layer are bonded together.

23. The mattress overlay as recited in claim 21, wherein the plurality of support pads are positioned in spaced relation to each other with a space between each pair of adjacent support pads, and wherein the second cushion layer is bonded to the first cushion layer between each pair of adjacent support pads to maintain the support pads in position.

24. The mattress overlay as recited in claim 21, wherein portions of each of the first and second cushion layers are bonded directly to each other.

25. The mattress overlay as recited in claim 21, wherein each of the plurality of support pads is positioned to support at least one of an individual's shoulders, buttocks and heels when the individual is lying on the mattress.

26. The mattress overlay as recited in claim 21, wherein the fluid in at least one of the plurality of fluid-filled cells is a gel material.

27. The mattress overlay as recited in claim 21, wherein the plurality of fluid-filled cells are permanently sealed along the plurality of seams.

28. The mattress overlay as recited in claim 21, in combination with a mattress.

29. The mattress overlay as recited in claim 28, wherein the first cushion layer is disposed against the mattress and the plurality of fluid-filled cells face away from the first cushion layer.

* * * * *